US007536140B2

(12) United States Patent
Andoh et al.

(10) Patent No.: US 7,536,140 B2
(45) Date of Patent: May 19, 2009

(54) DEVELOPER HOLDING MEMBER, METHOD OF PRODUCING A DEVELOPER HOLDING MEMBER, DEVELOPING APPARATUS AND IMAGE-FORMING APPARATUS

(75) Inventors: Masahiro Andoh, Minamiashigara (JP); Akihiko Noda, Ebina (JP); Yoshifumi Ozaki, Ebina (JP); Shota Oba, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 486 days.

(21) Appl. No.: 11/396,601

(22) Filed: Apr. 4, 2006

(65) Prior Publication Data

US 2007/0092307 A1 Apr. 26, 2007

(30) Foreign Application Priority Data

Oct. 26, 2005 (JP) ..... 2005-311770

(51) Int. Cl.
*G03G 15/09* (2006.01)
*G03G 15/08* (2006.01)

(52) U.S. Cl. ..... 399/276; 399/286

(58) Field of Classification Search ..... 399/265, 399/267, 276, 279, 286; 347/140; 430/97, 430/120.1, 122.1
See application file for complete search history.

(56) References Cited

U.S. PATENT DOCUMENTS

| | | | | |
|---|---|---|---|---|
| 5,286,917 | A * | 2/1994 | Unno et al. | 399/279 |
| 5,589,916 | A * | 12/1996 | Sutoh et al. | 399/286 |
| 6,201,942 | B1 * | 3/2001 | Honda et al. | 399/286 |
| 6,327,452 | B1 * | 12/2001 | Jaskowiak et al. | 399/286 |
| 6,512,910 | B2 * | 1/2003 | Aoki et al. | 399/276 |
| 6,733,891 | B1 * | 5/2004 | Blair et al. | 399/276 X |
| 6,873,816 | B2 * | 3/2005 | Akashi et al. | 399/286 |

FOREIGN PATENT DOCUMENTS

| | | |
|---|---|---|
| JP | A 7-281517 | 10/1995 |
| JP | A 2000-231257 | 8/2000 |

* cited by examiner

*Primary Examiner*—Sandra L Brase
(74) *Attorney, Agent, or Firm*—Oliff & Berridge, PLC

(57) ABSTRACT

The present invention provides a developer holding member having a surface layer composed of metal on or above a roughened hollow cylindrical substrate, wherein the specular gloss at 60°, Gs (60°), of the surface layer is in the range of approximately 10 to 40 gloss units, a developing apparatus and image-forming apparatus having the developer holding member, and a method of producing the developer holding member.

18 Claims, 6 Drawing Sheets

DEVELOPER HOLDING MEMBER, METHOD OF PRODUCING A DEVELOPER HOLDING MEMBER, DEVELOPING APPARATUS AND IMAGE-FORMING APPARATUS

CROSS-REFERENCE TO RELATED APPLICATION

This application claims priority under 35 USC 119 from Japanese Patent Application No. 2005-311770, the disclosure of which is incorporated by reference herein.

BACKGROUND OF THE INVENTION

1. Field of the Invention

The present invention relates to a developer holding member, a method of producing a developer holding member and an image-forming apparatus and in particular to a developer holding member used in a copier or printer utilizing electrophotographic method, a method of producing a developer holding member, a developing apparatus and an image-forming apparatus.

2. Description of the Related Art

In a copier or printer utilizing an electrophotographic process, an electrostatic latent image formed on a photoreceptor is developed by electrostatically adsorbing a developer onto the electrostatic latent image, and a cylindrical developer holding member is used to supply a developer. In such development, an amount of developer depending on the charging potential of a photoreceptor must be supplied to the electrostatic latent image.

However, when a developer of small particle diameter or a developer of high charging performance is used, a development performance distribution of the developer on the developer holding member is generated depending on the development history, and as a result, in some cases developer of an amount according to the charging potential of the photoreceptor is not supplied. The cause of this phenomenon, called ghost development, can be qualitatively explained below.

FIG. 5 shows an outline of a developing apparatus using a magnetic toner. The developing apparatus is composed of a developer holding member 11, a magnet 12, a developer hopper 13 and a developing blade 14. A developer 15 is stored in the developing hopper 13, and the developer is attracted towards the developer holding member 11 by the magnetism of the magnet 12. By rotating the developer holding member 11, the developer, having adhered to the developer holding member, is regulated by the developing blade 14 so as to have a predetermined thickness. The developer is electrostatically charged by friction among developer particles and friction between the developer and the developing blade 14. In a position near to an electrostatic latent image holding member 16, the charged developer is transferred by Coulomb force onto an electrostatic latent image on the electrostatic latent image holding member thereby visualizing the electrostatic latent image. Among developer particles on the developer holding member 11, only the developer positioned on a part corresponding to the electrostatic latent image is consumed in visualization of the latent image. By rotation of the developer holding member, new developer is supplied to the consumed portion and charged by the developing blade 14.

Because the development is carried out in this way, new developer supplied to the portion where the previous developer was consumed in the developing process undergoes frictional charging only once by the developing blade, whereas the developer on the portion where it was not consumed in the process undergoes frictional charging again.

As a result, the charging amount of the developer on the developer holding member 11 becomes distributed depending on the development history. As the charging amount is increased, the Coulomb interaction between the developer and the electrostatic latent image is increased and simultaneously the attraction between the developer and the developer holding member is also enhanced due to the image force. The amount of developer transferred onto the electrostatic latent image, that is, development performance, is determined by the relationship in magnitude between these forces.

In actual development, therefore, there occur cases where the development performance of the portion newly supplied with developer becomes higher or lower than that of other portions, accordingly an image different from the electrostatic latent image appears in the resulting print.

For example, consider copying a manuscript having a written portion "AAAAA" and a halftone region of uniform density, as shown in FIG. 6A. Usually, the circumferential speed of the developer holding member 11 is higher than that of the electrostatic latent image holding member 16, however for the sake of description, it is assumed that the two have the same circumferential speed. It is also assumed that development proceeds downward in the FIG. 5.

Because the perimeter of the developer holding member is generally shorter than the length of the manuscript, the developer holding member has to be rotated several times for copying one manuscript. In FIGS. 6B and 6C, it is assumed that the length "L" is the perimeter length of the developer holding member. By developing this portion, a developer layer, in which development performance is distributed according to the electrostatic latent image, is formed on the surface of the developer holding member, and this layer is used in development of a next portion. In this case, if the development performance of the developer used in developing the letters is higher than that of the developer on the other portion, an image called a positive ghost, absent in the electrostatic latent image, can appear on the position corresponding to the perimeter (length L) of the developer holding member as a result of development, as shown in FIG. 6B. However, if the development performance in that portion is lower, there occurs a phenomenon called a negative ghost, as shown in FIG. 6C, in which although the electrostatic latent image is present, the electrostatic latent image is not developed.

As described above, the ghost development is related to the charging performance of the developer and thus becomes particularly significant where developer of small particle diameter or developer of improved charging performance is used.

For example, a method of suppressing generation of the ghost development by providing the surface of a developer holding member with a phenol resin- and carbon-containing resin layer having electrical conductivity and surface lubricating properties is disclosed as a technique for suppressing generation of ghost development (see for example, Japanese Patent Application Laid-Open (JP-A) No. 2000-231257).

Also, a method of suppressing generation of ghost development by providing the surface of a developer holding member with a coating of molybdenum is also disclosed (see, for example, JP-A No. 7-281517).

In the method which includes providing the surface of a developer holding member with a resin layer, however, the resin layer is abraded easily thus changing the surface profile of the sleeve with time during running, giving rise to the problem that there is only a short period of time during which the ghost development can be suppressed to a certain degree.

In the method which includes providing the surface of a developer holding member with the molybdenum layer, the charging properties of molybdenum are low where recently developed toners for fixing at low temperatures are used, thus giving rise to the problem of reduction in the density of the resulting image.

SUMMARY OF THE INVENTION

The present invention has been made in view of the above circumstances and provides a developer holding member, a method of producing a developer holding member, a developing apparatus and image-forming apparatus.

An aspect of the present invention is to provide a developer holding member having a surface layer composed of metal on or above a roughened hollow cylindrical substrate, wherein the specular gloss at 60°, Gs (60°), of a surface layer is in the range of approximately 10 to 40 gloss units.

Another aspect of the present invention is to provide a developing apparatus comprising the developer holding member of an aspect of the present invention, a developer supplying unit that supplies a developer onto the developer holding member, and a charging unit that charges the developer supplies from the developer supplying unit.

Another aspect of the present invention is to provide an image forming apparatus comprising at least a latent image holding member, a charging unit that charges a surface of the latent image holding member, a latent image forming unit that forms a latent image on the surface of the latent image holding member, the developing apparatus of another aspect of the present invention for developing the latent image with a toner to form a toner image, a transferring unit that transfers the toner image onto the transfer receiving material, and a fixing unit that fixes the toner image onto a transfer receiving material.

Another aspect of the present invention is to provide a method of producing the developer holding member of an aspect of the present invention, comprising forming a surface layer by electroplating a roughened hollow cylindrical substrate with a metal-containing electrolyte to form a surface layer having a specular gloss at 60°, Gs (60°), of approximately 10 to 40 gloss units composed of a metal, on or above the surface of the substrate.

BRIEF DESCRIPTION OF THE DRAWINGS

Preferred embodiments of the present invention will be described in detail based on the following figures, wherein:

FIG. 1A is a general view and FIG. 1B is an enlarged view of a surface layer of the developer holding member;

DETAILED DESCRIPTION OF THE INVENTION

<Developer Holding Member>

The developer holding member of the invention has a surface layer composed of a metal on a roughened hollow cylindrical substrate, wherein the specular gloss at 60°, Gs (60°), of the surface layer is in the range of 10 to 40 gloss units.

The substrate in the invention is obtained by roughening the surface of a hollow cylinder. By surface roughening, the surface is made uneven. When a surface layer composed of metal is formed on the uneven surface of the substrate, the surface of the surface layer is also made uneven due to the unevenness of the substrate. This state is shown in FIG. 1.

When a developer is allowed to adhere to the produced developer holding member 11, the developer is easily captured onto the unevenness (macroscopic unevenness "r" in FIG. 1) of the surface of the surface layer 20 attributable to the unevenness of the substrate 10, to facilitate delivery of the developer onto a latent image holding member. However, an extremely uneven surface leads to frequent generation of the ghost development.

Figure 1A:
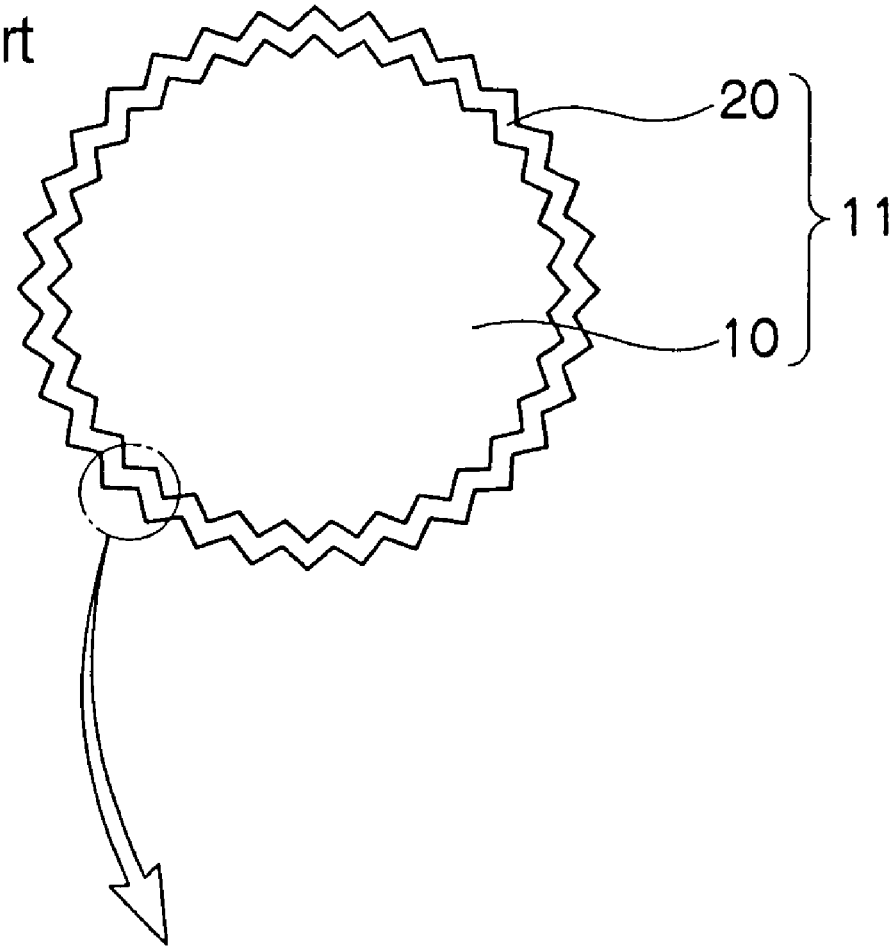
FIG.1A Related Art
FIGS. 1A and 1B are schematic views showing one example of a conventional developer holding member, where
Figure 1B:
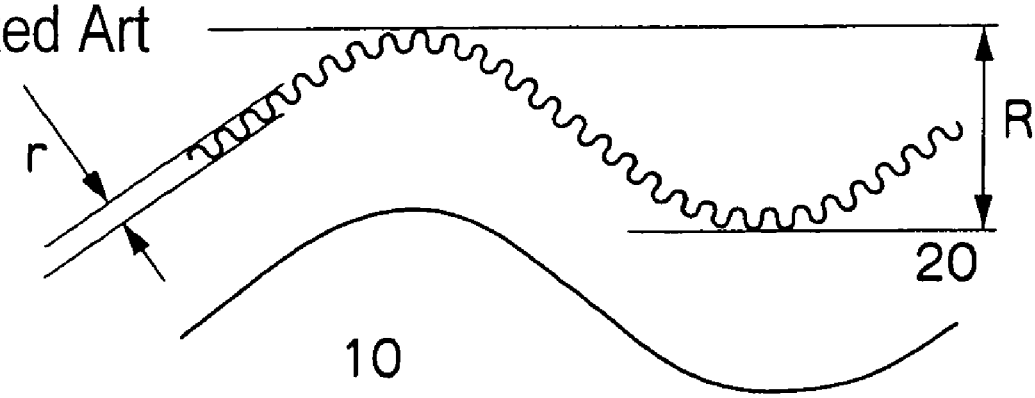
FIG.1B Related Art

When the unevenness of the surface is enlarged as shown in FIG. 1, there is more minute unevenness. It was revealed that toner particles remain on the concave portion of this minute unevenness (microscopic unevenness "r" in FIG. 1B) to cause further generation of the ghost development. That is, the toner particles remaining on the microscopic unevenness "r" of the surface layer continue to remain without being transferred for development, so the remaining toners are charged in the subsequent charging step. Accordingly, it can be thought that charging of newly fed toners is not carried out smoothly, resulting in generating the ghost.

Figure 2:
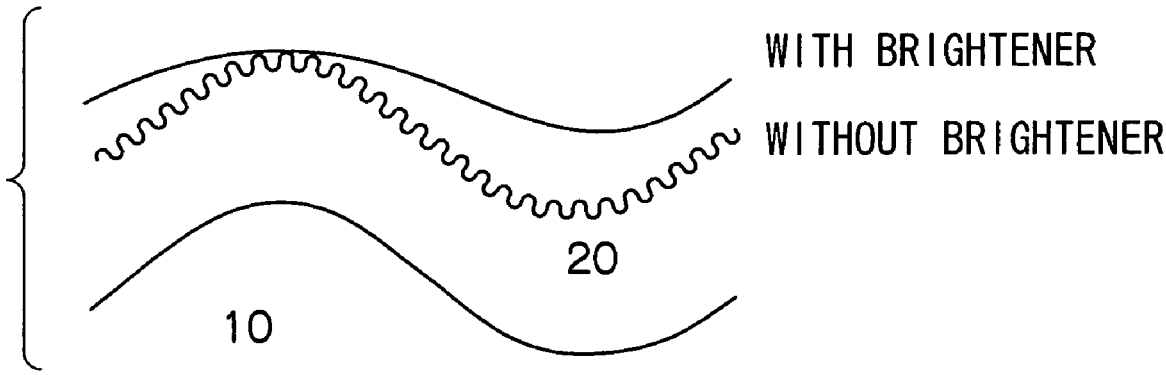
FIG. 2 is an enlarged view of a surface layer of the developer holding member of the present invention.

Accordingly, addition of a brightener to the surface layer is preferably conducted in the invention so that as shown in FIG. 2, the microscopic unevenness "r" is flattened, and simultaneously the macroscopic unevenness "R" is made smoother than the unevenness of the substrate. As a result, the developer holding member of the invention has a surface layer having suitable macroscopic unevenness "R" and flattened microscopic unevenness "r". By this structure, the developer holding member can deliver toners easily and prevent toners from remaining thereon, to prevent generation of the ghost development for a prolonged period of time.

Thus, the invention is characterized by regulation of the microscopic unevenness "r" in addition to regulation of the macroscopic unevenness "R" of the surface layer 20, so the unevenness in the invention shall be specified not only by the arithmetic mean surface roughness Ra of the macroscopic unevenness "R", but also by the specular gloss at 60° (Gs (60°)) of the surface layer 20.

Hereinafter, the constitution of the developer holding member is described in detail.

-Substrate-

The substrate in the invention is in a hollow cylindrical form. Usually, the substrate is made of aluminum, an alloy thereof, SUS or the like, but is preferably made of aluminum or an alloy thereof in order to roughen the surface of the substrate in the invention, as described later.

To increase the amount of the developer carried by the developer holding member, a hollow cylindrical substrate subjected to surface roughening is used in the invention. In the invention, the "surface roughening" refers to the treatment by which the arithmetic mean surface roughness $Ra_1$ of the substrate becomes 1.0 μm or more. The surface roughening of the substrate includes blasting with abrasive grains in a dry system, honing with abrasive grains in a wet system, and grinding with a grindstone.

In the invention, the surface roughness of the substrate, in terms of arithmetic mean surface roughness $Ra_1$, is preferably in the range of approximately 1.4 μm to 3.5 μm, more preferably approximately 1.7 μm to 3.2 μm, still more preferably approximately 2.5 μm to 3.1 μm. $Ra_1$ outside of these ranges is not preferable because when $Ra_1$ is less than 1.4 μm, the amount of the developer carried by the developer holding member is hardly secured, while when $Ra_1$ is greater than 3.5 μm, the curvature of the developer holding member is significant at the time of surface roughening, thus making accurate production difficult in some cases.

The arithmetic mean surface roughness $Ra_1$ of the substrate is measured by Surfcom 1400A-3DF (manufactured by TOKYO SEIMITSU Co., Ltd.), according to JIS B0601 (2001). Specifically, the arithmetic mean surface roughness $Ra_1$ is determined by measuring 9 points (3 points in peripheral direction×3 points in axial direction) along the axial direction under measurement conditions of a stylus top of 2 μm R, a measuring rate of 0.3 mm/s, a cutoff value of 0.8 mm and a measurement length of 4.0 mm and calculating their mean. Hereinafter, "arithmetic mean surface roughness" is determined by this measurement method.

-Surface Layer-

The developer holding member of the invention has a surface layer composed of metal on the substrate described above. The specular gloss at 60° (Gs (60°)) of the surface layer is in the range of approximately 10 to 40, preferably approximately 13 to 35, more preferably approximately 15 to 30, still more preferably approximately 15 to 21. When the specular gloss at 60° (Gs (60°)) of the surface layer is less than 10, the ghost may occur on an image, while when the gloss is higher than 40, the flattening of the surface is so strong that a developer is not carried uniformly, thus causing uneven density on an image in some cases.

The specular gloss of the surface layer can be regulated in the above range by suitably regulating the thickness and surface roughness of the surface layer, the concentration of a brightener and current density in forming the surface layer.

The specular gloss at 60° (Gs (60°)) in the invention refers to a value measured according to Method 3 in JIS Z8741 (1997). This document is incorporated by reference herein.

The metal used to constitute the surface layer includes nickel, copper, zinc, tin, gold, palladium, rhodium, ruthenium etc., and is preferably nickel, copper, zinc or tin, more preferably zinc or tin, still more preferably zinc. The reason that these metals are preferable is not elucidated, but is estimated as follows:

Generally, as the charging properties of the surface layer are enhanced, image density is increased, however the ghost occurs frequently. Accordingly, molybdenum or the like poor in charging properties is used from a practical viewpoint to prevent generation of the ghost in the prior art with the sacrifice of image density. In the invention, however, metals such as zinc and tin having higher charging properties than those of molybdenum, which are hardly usable in the prior art from the viewpoint of generation of the ghost, can be used in the surface layer. In the invention, therefore, an image of high density can be obtained while the ghost can be prevented from occurring thereon by using zinc, tin, etc. in the surface layer of the developer holding member.

The surface roughness of the surface layer, in terms of arithmetic mean surface roughness $Ra_2$, is preferably in the range of approximately 1.0 μm to 3.2 μm, preferably approximately 1.7 μm to 2.9 μm, more preferably approximately 2.3 μm to 2.85 μm. $Ra_2$ outside of these ranges is not preferable because when $Ra_2$ is less than 1.0 μm, the amount of the developer carried by the developer holding member is hardly secured, while when $Ra_2$ is greater than 3.2 μm, the delivery performance is improved to increase the amount of the developer to be developed, however the developer becomes unevenly charged so that because of inclusion of the low-charged developer, image defects in qualities of letters and solid images in the rear edge may be caused by toner scattering.

The arithmetic mean surface roughness $Ra_2$, as determined herein, corresponds to a value obtained by measuring the macroscopic unevenness in FIG. 2.

The ratio of the arithmetic mean surface roughness $Ra_2$ of the surface layer to the arithmetic mean surface roughness $Ra_1$ of the substrate, that is, $Ra_2/Ra_1$, is preferably approximately 0.7 to 1, more preferably approximately 0.75 to 0.99, still more preferably approximately 0.80 to 0.98. $Ra_2/Ra_1$ outside of these ranges is not preferable because when the $Ra_2/Ra_1$ ratio is less than 0.7, the surface of the developer holding member is highly smoothed and the developer is delivered unevenly to cause uneven image density in some cases, while when the $Ra_2/Ra_1$ ratio is greater than 1.0, the toner remains on the concave portion of the microscopic unevenness "r" to cause the ghost in some cases.

To attain such surface roughness (including both macroscopic and microscopic roughness) of the surface layer, a brightener is preferably added. The amount of the brightener added cannot be generalized and varies depending on the type of metal or brightener, and preferably the amount of the brightener added is regulated as necessary such that the arithmetic mean surface roughness $Ra_2$ is in the range defined above.

The brightener that can be added to the surface layer is not particularly limited insofar as the surface layer can be regulated in the range of the arithmetic mean surface roughness $Ra_2$, and for example, brighteners for zinc include Duozinc 100, Zinc Light 1600, Zinc Light S-3400, Zinc Light K-2500, Zinc Light K-7500, Zinc NH, Zinc A-100, Zinc A-200, Zinc ACK and Zinc A (manufactured by Okuno Chemical Industries Co., Ltd.), and brighteners for tin include Topflowna R and Topflowna MU (manufactured by Okuno Chemical Industries Co., Ltd.). Brighteners for nickel include Super Neolight, Super Zener, Monolight, Top Serina, Top Lunar, Top Leona NL, Acna B-30, Acna B and Turbo Light (manufactured by Okuno Chemical Industries Co., Ltd.), #810, #81, #83 and #81-J (manufactured by Ebara-UDYLITE CO., LTD.), and brighteners for copper include KOTAC1 and KOTAC2 (manufactured by Daiwa Tokushu Co., Ltd.), Elecopper 25MU and Elecopper 25A (manufactured by Okuno Chemical Industries Co., Ltd.).

The surface layer may consist of a single layer or two or more layers.

The thickness of the surface layer is preferably in the range of approximately 0.3 μm to 30 μm, more preferably approximately 0.6 to 7 μm, still more preferably approximately 2.5 μm to 4 μm. The thickness outside of these ranges is not preferable because when the thickness of the surface layer is less than 0.3 μm, the surface layer is abraded during the repeated running to expose the substrate, thus failing in maintaining suppression of the ghost in some cases, while when the thickness is greater than 30 μm, the in-plane roughness of the surface layer varies due to large thickness, to generate uneven image density in some cases, and from the viewpoint of production cost, the thickness of the surface layer is desirably thinner. The thickness of the surface layer is mean thickness determined by measuring 36 points in total (4 points in peripheral direction×9 points in axial direction) per developer holding member, by using a fluorescence X-ray film-thickness meter (SFT3000S, manufactured by SII).

When the surface layer is composed of two or more layers, the total thickness of all the layers is preferably in the above range.

The surface layer is formed on a substrate preferably by electroplating the surface-roughened substrate in an electrolyte containing a metal constituting the surface layer. After a brightener is added to, and mixed uniformly with, the electrolyte, electrolysis is carried out with the substrate as a cathode.

The specular gloss at 60°, Gs (60°), and surface roughness of the surface layer can be regulated by adjusting the amount of a brightener added to the surface layer and the thickness of the surface layer. The specular gloss at 60°, Gs (60°), and surface roughness of the surface layer are influenced by the surface roughness of the substrate, and thus it is preferable that the surface roughness of the substrate, the amount of the brightener added, and the thickness of the surface layer are suitably regulated.

The thickness of the surface layer can be regulated by electrolysis temperature, current density or electrolysis time.

By increasing the amount of the brightener added to the surface layer or by increasing the thickness of the surface layer, the specular gloss at 60° Gs (60°) of the surface layer can be increased and the surface roughness of the surface layer can be decreased.

The thickness of the surface layer can be increased by increasing electrolyte temperature, by increasing current density or by prolonging electrolysis time.

-Other Layers-

Insofar as the developer holding member of the invention has at least the substrate and the surface layer, the developer holding member is not particularly limited, and may be provided with, for example, an undercoat layer for improving adhesiveness between the substrate and the surface layer and for regulating the charging amount. As a matter of course, the developer holding member may not be provided with an undercoat layer. The undercoat layer makes use of a metal such as, for example, nickel, copper, chromium and gold, among which nickel or copper is preferably used.

The undercoat layer may consist of a single layer or two or more layers. The thickness of the undercoat layer in total is preferably approximately 0.3 μm to 5.0 μm, more preferably approximately 1.5 μm to 4.0 μm.

The undercoat layer is formed preferably by electrolytic plating or non-electro plating, more preferably by non-electro plating.

<Developing Apparatus>

The developing apparatus of the invention comprises a developer holding member, a developer feeding unit for feeding a developer onto the developer holding member, and a charging unit for charging the developer fed from the developer feeding unit.

The developer holding member in the developing apparatus of the invention is the above-described developer holding member having a surface layer in a specific surface state on a surface-roughened substrate. By using the developer holding member, generation of the ghost development can be suppressed for a prolonged period of time in the developing apparatus of the invention.

The developer feeding unit in the developing apparatus of the invention is not particularly limited insofar as it is a unit such as an agitating member (agitator) or an auger that is a spiral delivery member, which is used in feeding a developer to the developer holding member, and a unit usually applied to a developing apparatus can be suitably used.

The charging unit in the developing apparatus of the invention can be used without particular limitation insofar as it can charge a developer to such a level that the developer can be transferred by Coulomb force onto an electrostatic latent image on an electrostatic latent image holding member, and a charging unit usually used in a developing apparatus can be suitably used. Usually, the developer is charged by friction among developer particles and friction between the developer and a developer layer-regulating member by which the developer adhering to the developer holding member is regulated to have predetermined thickness.

The developer applicable to the invention may be a magnetic one-component or two-component developer in order to achieve the effect of the invention, however the effect of the invention can be achieved more fully by the magnetic one-component developer.

As the composition of the developer applicable to the developing apparatus of the invention, a composition applied usually to a developer can be suitably applied.

Figure 3:
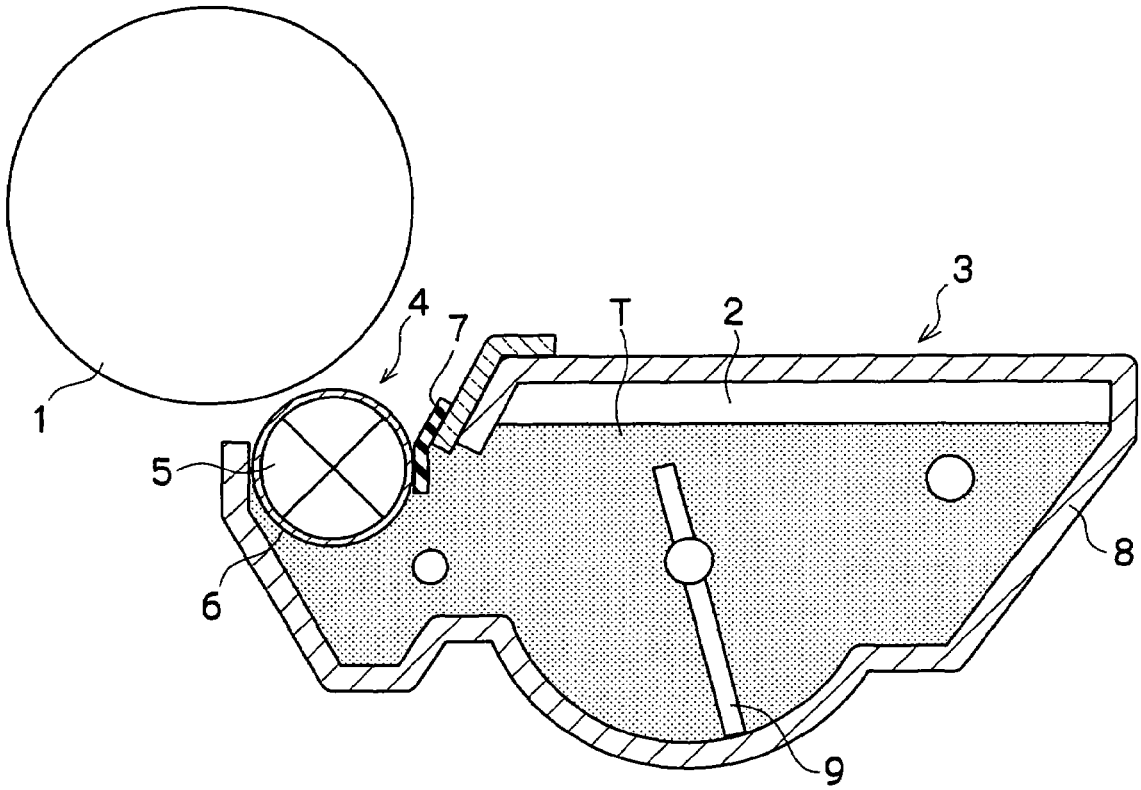
FIG. 3 is a schematic view showing one example of the developing apparatus of the invention.

FIG. 3 is a non-limiting example of a developing apparatus suitable for carrying out the invention.

In FIG. 3, a developing apparatus 3 is arranged opposite to an image holding member 1. A developing housing 8 is provided therein with a developing roll unit (developer holding member) 4 and an agitating member (developer feeding unit) 9. The developing roll unit 4 is provided with a magnet roll 5 for forming a magnetic field uniformly in the axial direction, a developing sleeve 6 fit onto the outer periphery of the magnet roll 5, and a developer layer-regulating member 7 composed of a soft elastic body abutted onto the developing sleeve 6.

The magnet roll 5 has e.g. a magnetic pattern indicated as N and S in the figure and is fixed, in the developing sleeve 6, to the developing housing 8. The developing sleeve 6 is supported in a freely rotatable manner in the developing housing 8. The agitating member 9 for agitating developer T is also arranged in a rotatable manner in the developing housing 8.

As the developing sleeve 6, a sleeve substrate having known metallic plating, anodized film or a resin layer thereon can be preferably used. The material, shape and structure of the substrate can be suitably selected depending on the subject, however generally the shape is cylindrical or the like, and the material includes, for example, aluminum, copper, non-electrolyzed copper, nickel, non-electrolyzed nickel, nickel-cadmium dispersion, hard chromium, black chromium, gold, silver, rhodium, platinum, palladium, ruthenium, tin, indium, iron and cadmium. As the anodized film, anodized aluminum film is used most widely, and additionally oxides such as anodized molybdenum, iron or copper may also be used.

As the resin layer, it is possible to use phenol resin, epoxy resin, melamine resin, polyurea, polyamide resin, polyimide resin, polyurethane resin, polycarbonate resin, acrylic resin, styrene resin, fluorine resin, silicone resin, etc.

The developer layer-regulating member 7 used in the invention can be constituted by using a plate material such as stainless steel, copper, iron or resin having a soft elastic sheet formed thereon. The soft elastic sheet is a sheet produced by molding a soft elastic body such as silicone rubber, urethane rubber, butadiene rubber, natural rubber, isoprene rubber, styrene butadiene rubber, butyl rubber, nitrile butadiene rubber, chloroprene rubber, ethylene propylene rubber or epichlorohydrin rubber, or similarly use can be made of a sheet constituted by attaching the above sheet directly to sheet metal such as iron, stainless steel or aluminum.

Developer T is agitated and delivered in the hopper 2 by rotation of the agitating member 9, and the developer T coping with high-quality image can be fed to the side of the developing roll unit 4. The developer T is allowed to adhere by the magnetism of the magnet roll 5 to the surface of the developing sleeve 6, followed by charging by friction and simultaneous regulation of the layer thickness by the projection and abutting pressure of the developer layer-regulating member 7. The developer thus charged by friction and delivered onto the developing sleeve 6 is transferred depending on its charging amount to the image holding member 1 and developed.

In such developing method, the surface of the developer holding member is subjected to strong stress particularly by friction between the developing sleeve 6 and the developer-regulating member 7 such that the developer is pressed against the surface of the developer holding member. When the developer holding member of the invention is used, the developer is hardly embedded in the surface of the developer holding member and thus hardly remains on the surface of the developer holding member. The amount of the developer delivered to the image holding member 1 is stabilized, and thus generation of the ghost development can be suppressed for a prolonged period of time, and stabilized image density can be obtained.

<Image Forming Apparatus>

The image forming apparatus of the invention comprises at least a latent image holding member, a unit of forming a latent image on the surface of the latent image holding member, the developing apparatus of the invention for developing the latent image with a toner to form a toner image, and a unit of transferring the toner image onto a transfer material.

Figure 4:
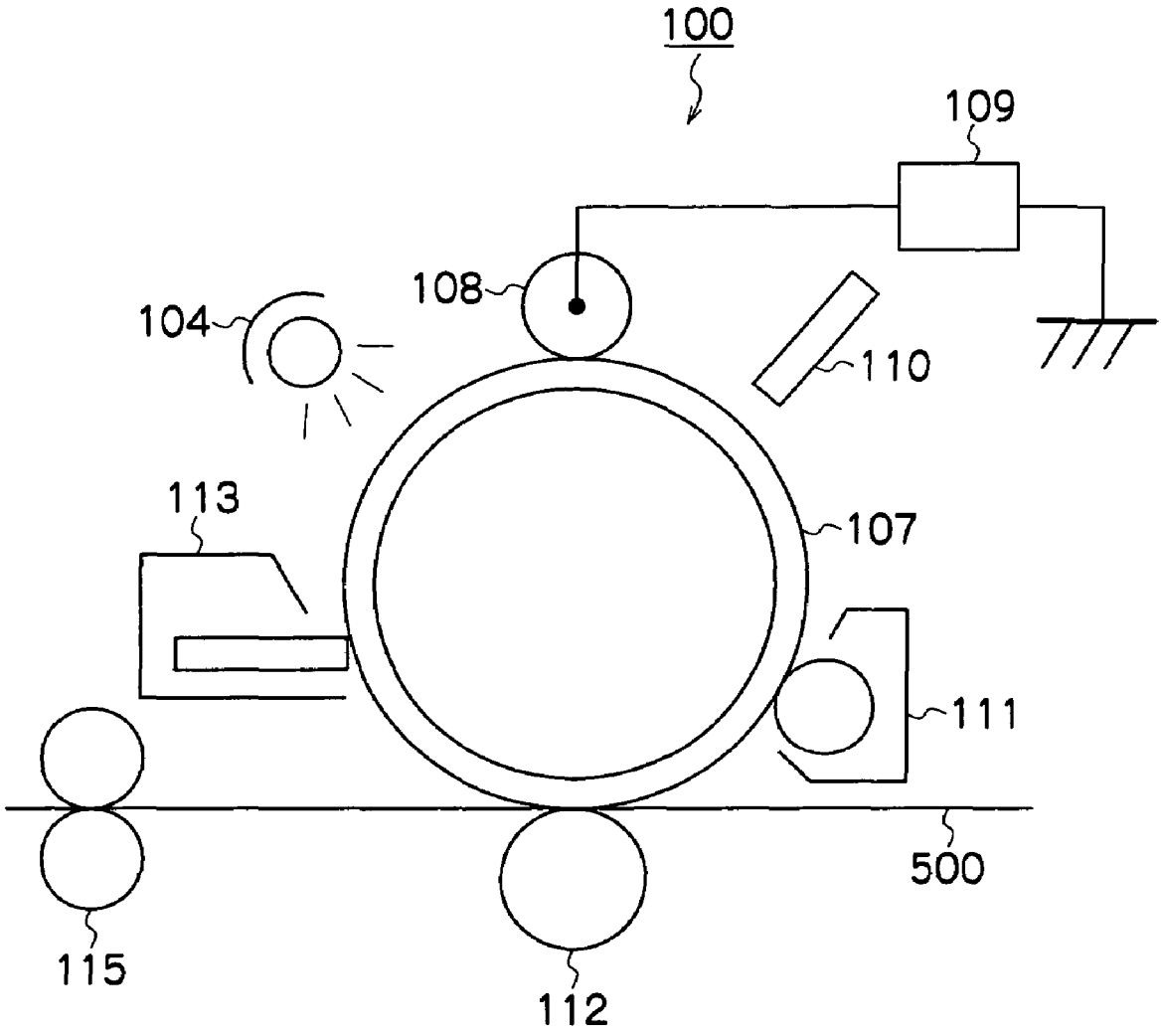
FIG. 4 is a schematic view showing one example of the image-forming apparatus of the invention.
Figure 5:
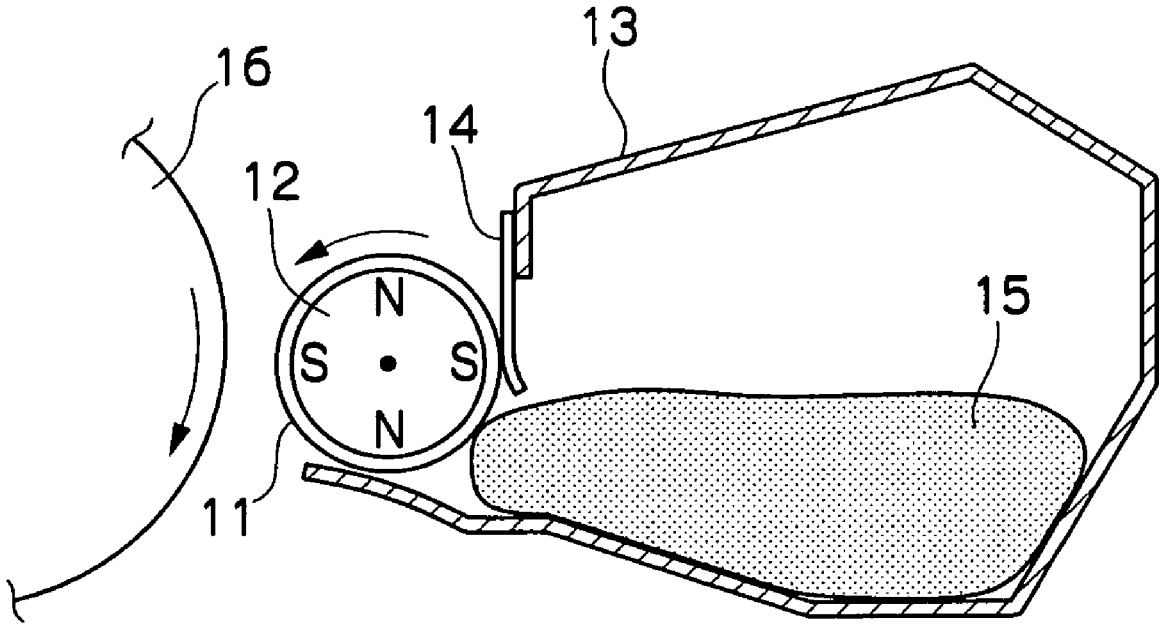
FIG. 5 is a view showing a general constitution of the developing apparatus.

FIG. 4 is a schematic section showing a fundamental constitution of one preferable embodiment of the image-forming apparatus of the invention. An image-forming apparatus 100 shown in FIG. 4 includes an electrophotographic photoreceptor (image holding member) 107, a charging device 108 such as a corotron or scorotron for charging the electrophotographic photoreceptor 107, a power source 109 connected to the charging device 108, a light-exposing device (latent image-forming unit) 110 for forming an electrostatic latent image by light exposure of the electrophotographic photoreceptor 107 charged by the charging device 108, a developing apparatus (developing unit) 111 for developing the electrostatic latent image formed by the light-exposing device 110 to form a toner image, a transferring device (transferring unit) 112 for transferring the toner image formed by the developing apparatus 111 to a transfer body 500, a cleaning device 113 for removing toners remaining on the electrophotographic photoreceptor 107 after transfer, an electrostatic eliminator 104, and a fixing apparatus (fixing unit) 115.

As the devices and apparatuses in the image-forming apparatus 100, those used in conventional image-forming apparatuses can be used.

In the invention, the image-forming apparatus may not include the electrostatic eliminator 104. In FIG. 4, the charging device 108 is a contact-type charging device, however may be a non-contact-type charging device such as corotron charger.

If necessary, the image-forming apparatus may have another constitution applied usually to image-forming apparatuses.

Some embodiments of the invention are outlined below.

According to an aspect of the invention, a developer holding member having a surface layer composed of metal on or above a roughened hollow cylindrical substrate, wherein the specular gloss at 60°, Gs (60°), of a surface layer is in the range of approximately 10 to 40 gloss units.

The arithmetic mean surface roughness, $Ra_2$, of the surface layer is in the range of approximately 1.0 μm to 3.2 μm.

The metal forming the surface layer is at least one metal selected from the group consisting of Ni, Cu, Zn, Sn and alloys thereof.

The thickness of the surface layer is in the range of approximately 0.3 μm to 30 μm.

The surface layer comprises a brightener.

The ratio of the arithmetic mean surface roughness $Ra_2$ of the surface layer to the arithmetic mean surface roughness $Ra_1$ of the substrate, that is, $Ra_2/Ra_1$, is approximately 0.7 to less than 1.

The arithmetic mean surface roughness $Ra_1$ of the substrate is in the range of approximately 1.4 μm to 3.5 μm.

The substrate is aluminum or an alloy thereof.

The substrate is surface-roughened by blasting, honing, or grinding with a grindstone.

An undercoat layer composed of at least one metal selected from the group consisting of Ni and Cu is arranged between the substrate and the surface layer.

The thickness of the undercoat layer is in the range of approximately 1.5 μm to 4.0 μm.

The undercoat layer is formed by non-electro plating.

According to another aspect of the invention, a developing apparatus comprising the developer holding member of a aspect of the invention, a developer supplying unit that supplies a developer onto the developer holding member, and a charging unit that charges the developer supplies from the developer supplying unit.

The developer is a magnetic one-component developer.

According to another aspect of the invention, an image forming apparatus comprising at least a latent image holding member, a charging unit that charges a surface of the latent image holding member, a latent image forming unit that forms a latent image on the surface of the latent image holding member, the developing apparatus of another aspect of the invention for developing the latent image with a toner to form a toner image, a transferring unit that transfers the toner image onto a transfer receiving material, and a fixing unit that fixes the toner image onto the transfer receiving material.

According to another aspect of the invention, a method of producing the developer holding member of an aspect of the invention, comprising forming a surface layer by electroplating a roughened hollow cylindrical substrate with a metal-containing electrolyte to form a surface layer having a specular gloss at 60°, Gs (60°), of approximately 10 to 40 gloss units composed of a metal, on or above the surface of the substrate.

The metal is at least one metal selected from the group consisting of Ni, Cu, Zn, Sn and alloys thereof.

The method comprises roughening the surface of the substrate in the developer holding member to make the arithmetic mean surface roughness, $Ra_1$, in the range of approximately 1.4 μm to 3.5 μm.

EXAMPLE

Hereinafter, the present invention is described in more detail by reference to the Examples, however the invention is not limited to these Examples.

Example 1

A developer holding member provided with a surface layer composed of zinc is prepared. The method of producing the same is described below in detail.

(Preparation of a Developer Holding Member Zn-1)

-Preparation of a Substrate-

A hollow cylindrical Al (aluminum: A6063) pipe cut after drawing is blasted with spherical abrasives FGB#60/#40. The blasting pressure is 0.2 MPa and the blasting time is 60 seconds.

The arithmetic mean surface roughness $Ra_1$ of the resulting aluminum pipe (substrate), as determined by the method described above, is 2.8 μm.

-Formation of a Surface Layer-

The aluminum pipe (substrate) thus subjected to blasting is etched to improve adhesion to plating and then treated with double zincate.

Separately, a treating solution is prepared by adding a brightener (trade name: Zinc Light 1600, manufactured by Okuno Chemical Industries Co., Ltd.) in an amount of 4 ml/l to a zinc cyanide bath produced by using a main agent (zinc oxide reagent, manufactured by Showa Chemical Co., Ltd.). The treating solution is used in zinc electrolysis where the aluminum pipe (substrate) subjected above to double zincate is used as a cathode, to form a surface layer composed of zinc thereon.

After zinc electrolysis, the substrate is washed several times with water, then neutralized with nitric acid, washed several times with water and then dried for 10 minutes or more in an atmosphere at 50° C., to prepare a developer holding member Zn-1. The specular gloss at 60° Gs (60°) of the resulting surface layer, as determined by the method described above, is 20. The arithmetic mean surface roughness $Ra_2$ of the surface layer is 2.60 μm, and the mean layer thickness is 2.5 μm.

(Preparation of Developer Holding Members Zn-2 to Zn-9)

Developer holding members Zn-2 to Zn-9 are prepared in the same manner as for the developer holding member Zn-1 except that while the brightener is added in an amount of 4 ml/l in preparation of the developer holding member Zn-1, the amount of the brightener added is regulated so as to attain gloss shown in Table 1. The specular gloss at 60°, Gs (60°), and arithmetic mean surface roughness $Ra_2$ of the resulting surface layer are shown in Table 1.

(Preparation of Developer Holding Members Zn-10 to Zn-19)

Developer holding members Zn-10 to Zn-19 are prepared in the same manner as in preparation of the developer holding member Zn-1 except that in the blasting treatment of the aluminum substrate, the blasting pressure/time is regulated to change the surface roughness of the substrate. The arithmetic mean surface roughness $Ra_1$ of the substrate is measured, and the result is shown in Table 2.

(Preparation of Developer Holding Members Zn-20 to Zn-28)

Developer holding members Zn-20 to Zn-28 are prepared in the same manner as for the developer holding member Zn-4 except that in the electrolysis treatment in formation of the surface layer, the electrolysis treatment time is changed to change the thickness of the surface layer while the conditions such as temperature and current density are fixed. The specular gloss at 60°, Gs (60°), arithmetic mean surface roughness $Ra_2$ and mean thickness of the resulting surface layer are shown in Table 3.

(Preparation of a Developer)

| | |
|---|---|
| Binder resin: Polyester resin (Alcohol component, bisphenol A/propylene oxide adduct; acid component, terephthalic acid; MI, 5 g/10 min.; Tg, 60° C.) | 50 parts by weight |
| Magnetite (particle diameter: 0.25 μm) | 50 parts by weight |
| Polypropylene wax (Trade name: 660P, manufactured by Sanyo Chemical Industries, Ltd.) | 3.5 parts by weight |

The materials in the composition are powder-mixed and heat-kneaded in an extruder set at a temperature of 140° C. After cooling, the mixture is ground coarsely and then ground finely to give a ground material having a volume-average particle diameter D50 of 5.8 μm. This ground material is classified to give a classified toner product having a D50 of 6.2 μm wherein the number of 4-μm or less toner particles is 22% relative to the number of all the toner particles.

1.2 parts by weight of dimethyl silicone oil-treated fine silica particles having a diameter 12 nm (carbon content, 7.5 mass %) and 0.6 parts by weight of fine titanium oxide particles having a mean primary particle diameter of 50 nm previously treated with 10 mass % decyltrimethoxysilane are externally added to 100 parts by weight of the resulting classified toner product in a Henschel mixer to prepare a magnetic one-component developer.

(Evaluation)

Figure 6A:
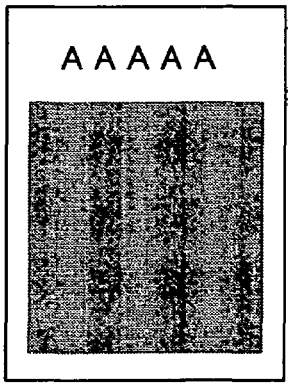
FIGS. 6A, 6B and 6C are illustrations showing generation of the ghost upon printing.
Figure 6B:
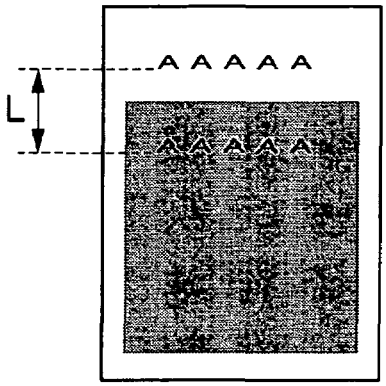
Figure 6C:
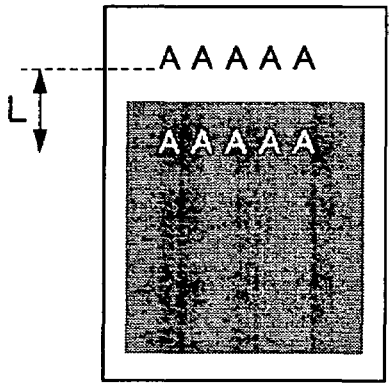

An image-forming apparatus (DocuPrint 340A, manufactured by Fuji Xerox Co., Ltd.) is modified by replacing its developer holding member by the developer holding members Zn-1 to Zn-28 prepared above, and using this modified apparatus, a solid black image is printed on 1 sheet and a solid white image on 3 sheets with the magnetic one-component developer prepared above, and then the ghost chart image shown in FIG. 6 is copied on 1 sheet, and this printing result is examined with the naked eye and evaluated under the following criteria.

-Image Ghost-

G1: The ghost is not generated.

G2: The ghost is slightly generated.

G3: The ghost is generated at practically acceptable level.

G4: The ghost is evidently generated and not acceptable.

The development is carried out using non-contact jumping development under the following conditions:

Development bias (AC): rectangular wave, 1.8 kV pp, duty ratio 50%, frequency 3.3 kHz.

Development bias (DC): −400 V.

$V_{HIGH}$, −500 V; $V_{LOW}$, −150V.

Gap between the drum and the developer holding member: 250 μm.

Ambient temperature, 28° C.; 85% RH.

The evaluation results are shown in Tables 1 to 3.

TABLE 1

| Developer holding member | Substrate Surface roughness ($Ra_1$) | Surface layer: Specular gloss at 60° (Gs (60°)) | Surface layer: Thickness Mean (μm) | Surface layer: Surface roughness ($Ra_2$) Mean (μm) | Image ghost | Remarks |
|---|---|---|---|---|---|---|
| Zn-1 | 2.8 | 20 | 2.5 | 2.60 | G1 | The invention |
| Zn-2 | 2.8 | 10 | 2.5 | 2.78 | G3 | The invention |
| Zn-3 | 2.8 | 13 | 2.5 | 2.76 | G2 | The invention |
| Zn-4 | 2.8 | 15 | 2.5 | 2.77 | G1 | The invention |
| Zn-5 | 2.8 | 30 | 2.5 | 2.41 | G1 | The invention |

TABLE 1-continued

| Developer holding member | Substrate Surface roughness ($Ra_1$) | Surface layer: Specular gloss at 60° (Gs (60°)) | Surface layer: Thickness Mean (μm) | Surface layer: Surface roughness ($Ra_2$) Mean (μm) | Image ghost | Remarks |
|---|---|---|---|---|---|---|
| Zn-6 | 2.8 | 35 | 2.5 | 2.32 | G2 | The invention |
| Zn-7 | 2.8 | 40 | 2.5 | 2.21 | G3 | The invention |
| Zn-8 | 2.8 | 9 | 2.5 | 2.80 | G4 | Comparative Example |
| Zn-9 | 2.8 | 41 | 2.5 | 2.19 | G4 | Comparative Example |

When the developer holding member having a surface layer with a specular gloss at 60°, Gs (60°), of 10 to 40 on a surface-roughened hollow cylindrical substrate is used, generation of the ghost is suppressed even in use for a prolonged period of time, as shown in Table 1. Particularly when the developer holding members Zn-1, Zn-4 and Zn-5 having a specular gloss at 60°, Gs (60°), of 15 to 30 are used, excellent results are obtained.

TABLE 2

| Developer holding member | Substrate: Surface roughness ($Ra_1$) Mean (μm) | Surface layer: Specular gloss at 60° (Gs (60°)) | Surface layer: Thickness Mean (μm) | Surface layer: Surface roughness ($Ra_2$) Mean (μm) | Image ghost | Remarks |
|---|---|---|---|---|---|---|
| Zn-10 | 0.5 | 43 | 2.5 | 0.30 | — | Comparative Example |
| Zn-11 | 1.3 | 25 | 2.5 | 1.00 | G3 | The invention |
| Zn-12 | 1.7 | 24 | 2.5 | 1.42 | G2 | The invention |
| Zn-13 | 1.9 | 23 | 2.5 | 1.70 | G2 | The invention |
| Zn-14 | 2.5 | 21 | 2.5 | 2.32 | G1 | The invention |
| Zn-15 (Zn-1) | 2.8 | 20 | 2.5 | 2.60 | G1 | The invention |
| Zn-16 | 3.1 | 19 | 2.5 | 2.81 | G2 | The invention |
| Zn-17 | 3.5 | 18 | 2.5 | 3.20 | G2 | The invention |
| Zn-18 | 3.8 | 17 | 2.5 | 3.52 | G3 | The invention |
| Zn-19 | 4 | 16 | 2.5 | 3.70 | G3 | The invention |

Table 2 indicates that when the surface roughness of the substrate is changed, the specular gloss at 60°, Gs (60°), is also changed, however when the Gs (60°) is in the range of 10 to 40, generation of the image ghost is suppressed by any of the developer holding members. Particularly when the developer holding members Zn-12 to Zn-17 having a substrate surface roughness $Ra_1$ of 1.7 to 3.5 are used, excellent results are obtained, and further preferable results are obtained when the developer holding members Zn-14 and Zn-15 having a substrate surface roughness $Ra_1$ of 2.5 to 2.8 are used. In the developer holding member Zn-10 using a cut pipe as a substrate having a surface roughness $Ra_1$ of 0.5 μm, not subjected to surface roughening, the gloss Gs (60°) of the surface layer is higher than 40 which is attributable to the surface roughness of the substrate, and image density as fundamental image property is not exhibited, so evaluation of the image ghost is not conducted. In the developer holding members Zn-18 and Zn-19 having substrate surface roughness $Ra_1$ of 3.8 and 4.0 μm respectively, their surface layers have gloss Gs (60°) of 17 and 16 respectively, so the gloss of these layers is in the range of the invention and not practically problematic, but the negative ghost is sometimes generated.

TABLE 3

| Developer holding member | Substrate: Surface roughness ($Ra_1$) Mean (μm) | Surface layer: Specular gloss at 60° (Gs (60°)) | Surface layer: Thickness Mean (μm) | Surface layer: Surface roughness ($Ra_2$) Mean (μm) | Image ghost | Remarks |
|---|---|---|---|---|---|---|
| Zn-20 | 2.8 | 10 | 0.1 | 2.72 | G3 | The invention |
| Zn-21 | 2.8 | 12 | 0.3 | 2.66 | G2 | The invention |
| Zn-22 | 2.8 | 14 | 0.6 | 2.57 | G2 | The invention |

TABLE 3-continued

| Developer holding member | Substrate Surface roughness ($Ra_1$) Mean (μm) | Surface layer Specular gloss at 60° (Gs (60°)) | Thickness Mean (μm) | Surface roughness ($Ra_2$) Mean (μm) | Image ghost | Remarks |
|---|---|---|---|---|---|---|
| Zn-23 (Zn-1) | 2.8 | 20 | 2.5 | 2.52 | G1 | The invention |
| Zn-24 | 2.8 | 21 | 4 | 2.41 | G1 | The invention |
| Zn-25 | 2.8 | 26 | 7 | 2.27 | G2 | The invention |
| Zn-26 | 2.8 | 34 | 15 | 2.15 | G2 | The invention |
| Zn-27 | 2.8 | 38 | 30 | 1.78 | G2 | The invention |
| Zn-28 | 2.8 | 40 | 45 | 1.30 | G3 | The invention |

Table 3 indicates that when the thickness of the surface layer is changed, the specular gloss at 60°, Gs (60°), and surface roughness $Ra_2$ of the surface layer are also changed, however when the Gs (60°) is in the range of 10 to 40, generation of the image ghost is suppressed by any of the developer holding members. It is found that the developer holding member Zn-20 is effective in suppressing generation of the image ghost, however when used in printing of about 1,300 sheets, the surface layer is abraded to expose the substrate in some cases. It is also found that in the developer holding member Zn-28, the in-plane roughness of the surface layer varies due to the large thickness of the layer, to cause uneven image density in some cases. Accordingly, it is found that the thickness of the surface layer is desirably 0.3 to 30 μm. From the viewpoint of production cost, the thickness is desirably smaller.

Accordingly, there can be provided a developer holding member capable of suppression of the ghost development generated according to development history for a prolonged period of time, resulting in formation of high-quality images, as well as a method of producing the developer holding member and an image-forming apparatus using the same.

Example 2

A developer holding member having a nickel undercoat layer between a substrate and a surface layer of zinc is prepared and evaluated.

(Preparation of Developer Holding Members Zn-29 to Zn-37)

-Preparation of an Undercoat Layer-

The same aluminum pipe (substrate) as in Example 1 is subjected to Ni—P non-electro plating with a main agent (trade name: Topnicolon BL-M/BL-1, manufactured by Okuno Chemical Industries Co., Ltd.), to form an undercoat layer of nickel having a thickness of 3.0±0.5 μm.

-Formation of a Surface Layer-

Developer holding member Zn-29 is prepared by forming a surface layer on the undercoat layer in the same manner as in Example 1. Developer holding members Zn-29 to Zn-37 are prepared in the same manner as for the developer holding members Zn-2 to Zn-9 in Example 1 by changing the amount of the brightener added to the surface layer. The specular gloss at 60°, Gs (60°), arithmetic mean surface roughness $Ra_2$ and mean thickness of the resulting surface layer are shown in Table 4.

(Preparation of Developer Holding Members Zn-38 to Zn-47)

Developer holding members Zn-38 to Zn-47 are prepared in the same manner as in preparation of the developer holding member Zn-32 (specular gloss at 60°, Gs (60°), of the surface layer: about 20) except that in the blasting treatment of the aluminum substrate, the blasting pressure/time is regulated to change the surface roughness of the substrate. The arithmetic mean surface roughness $Ra_1$ of the substrate is measured, and the result is shown in Table 5.

(Preparation of Developer Holding Members Zn-48 to Zn-56)

Developer holding members Zn-48 to Zn-56 are prepared in the same manner as for the developer holding member Zn-32 (specular gloss at 60°, Gs (60°), of the surface layer: 20) except that in the electrolysis treatment in formation of the surface layer, the electrolysis treatment time is changed to change the thickness of the surface layer while the conditions such as temperature and current density are fixed. The specular gloss at 60°, Gs (60°), arithmetic mean surface roughness $Ra_2$ and mean thickness of the resulting surface layer are shown in Table 6.

The resulting developer holding members Zn-29 to Zn-56 are evaluated in the same manner as in Example 1. The results are shown in Tables 4 to 6.

TABLE 4

| Developer holding member | Substrate Surface roughness ($Ra_1$) | Surface layer Specular gloss at 60° (Gs (60°)) | Thickness Mean (μm) | Surface roughness ($Ra_2$) Mean (μm) | Image ghost | Remarks |
|---|---|---|---|---|---|---|
| Zn-29 | 2.8 | 10 | 2.5 | 2.77 | G3 | The invention |
| Zn-30 | 2.8 | 13 | 2.5 | 2.75 | G2 | The invention |
| Zn-31 | 2.8 | 15 | 2.5 | 2.73 | G1 | The invention |
| Zn-32 | 2.8 | 20 | 2.5 | 2.64 | G1 | The invention |
| Zn-33 | 2.8 | 30 | 2.5 | 2.42 | G2 | The invention |
| Zn-34 | 2.8 | 35 | 2.5 | 2.34 | G2 | The invention |
| Zn-35 | 2.8 | 40 | 2.5 | 2.21 | G3 | The invention |

TABLE 4-continued

| Developer holding member | Substrate Surface roughness ($Ra_1$) | Surface layer: Specular gloss at 60° (Gs (60°)) | Surface layer: Thickness Mean (μm) | Surface layer: Surface roughness ($Ra_2$) Mean (μm) | Image ghost | Remarks |
|---|---|---|---|---|---|---|
| Zn-36 | 2.8 | 9 | 2.5 | 2.80 | G4 | Comparative Example |
| Zn-37 | 2.8 | 41 | 2.5 | 2.18 | G4 | Comparative Example |

TABLE 5

| Developer holding member | Substrate: Surface roughness ($Ra_1$) Mean (μm) | Surface layer: Specular gloss at 60° (Gs (60°)) | Surface layer: Thickness Mean (μm) | Surface layer: Surface roughness ($Ra_2$) Mean (μm) | Image ghost | Remarks |
|---|---|---|---|---|---|---|
| Zn-38 | 0.5 | 44 | 2.5 | 0.26 | — | Comparative Example |
| Zn-39 | 1.3 | 25 | 2.5 | 1.01 | G3 | The invention |
| Zn-40 | 1.7 | 24 | 2.5 | 1.42 | G2 | The invention |
| Zn-41 | 1.9 | 23 | 2.5 | 1.71 | G2 | The invention |
| Zn-42 | 2.5 | 21 | 2.5 | 2.30 | G1 | The invention |
| Zn-43 (Zn-32) | 2.8 | 20 | 2.5 | 2.64 | G1 | The invention |
| Zn-44 | 3.1 | 19 | 2.5 | 2.84 | G2 | The invention |
| Zn-45 | 3.5 | 18 | 2.5 | 3.23 | G2 | The invention |
| Zn-46 | 3.8 | 17 | 2.5 | 3.58 | G3 | The invention |
| Zn-47 | 4 | 16 | 2.5 | 3.72 | G3 | The invention |

TABLE 6

| Developer holding member | Substrate: Surface roughness ($Ra_1$) Mean (μm) | Surface layer: Specular gloss at 60° (Gs (60°)) | Surface layer: Thickness Mean (μm) | Surface layer: Surface roughness ($Ra_2$) Mean (μm) | Image ghost | Remarks |
|---|---|---|---|---|---|---|
| Zn-48 | 2.8 | 10 | 0.1 | 2.75 | G3 | The invention |
| Zn-49 | 2.8 | 12 | 0.3 | 2.68 | G2 | The invention |
| Zn-50 | 2.8 | 14 | 0.6 | 2.65 | G2 | The invention |
| Zn-51 (Zn-32) | 2.8 | 20 | 2.5 | 2.58 | G1 | The invention |
| Zn-52 | 2.8 | 21 | 4 | 2.40 | G1 | The invention |
| Zn-53 | 2.8 | 25 | 7 | 2.27 | G2 | The invention |
| Zn-54 | 2.8 | 34 | 15 | 2.15 | G2 | The invention |
| Zn-55 | 2.8 | 38 | 30 | 1.78 | G2 | The invention |
| Zn-56 | 2.8 | 40 | 45 | 1.30 | G3 | The invention |

Tables 4 to 6 indicate that when the undercoat layer of nickel is present, any developer holding members suppress generation of the image ghost insofar as the specular gloss at 60°, Gs (60°), of the surface layer made of zinc is in the range of 10 to 40.

It is found that the developer holding member Zn-48 is effective in suppressing generation of the image ghost, however when used in printing of about 1,300 sheets, the surface layer is abraded to expose the substrate in some cases. It is also found that in the developer holding member Zn-56, the in-plane roughness of the surface layer varies due to the large thickness of the layer, to cause uneven image density in some cases. Accordingly, it is found that the surface layer preferably has a thickness of 0.3 to 30 μm.

(Relationship Between the Thickness of the Surface Layer and the Charging Amount)

The developer holding members Zn-50 and Zn-51 are measured for charging amount in an atmosphere at 22° C. under 55% RH. The method of measuring charging amount is as follows.

A Faraday gauge having a suction nozzle and a filter, and a Coulomb meter, are used in a suction nozzle method. Specifically, a masking jig having an opening area of 2.5 $cm^2$ with the same surface curvature as that of the developer holding member is set on the developer holding member, and the developer on the developer holding member, exposed to the masking opening, is suctioned through the suction nozzle and retained in the Faraday gauge, and measured for its electrical charge and for an increase in weight after suction, to calculate the electrical charge per unit area.

The results are shown in Table 7.

TABLE 7

| Developer holding member | Substrate Surface roughness ($Ra_1$) Mean (μm) | Surface layer Specular gloss at 60° (Gs (60°)) | Thickness Mean (μm) | Surface roughness ($Ra_2$) Mean (μm) | Charging amount | Remarks |
|---|---|---|---|---|---|---|
| Zn-50 | 2.8 | 14 | 0.6 | 2.65 | −9.36 | The invention |
| Zn-51 | 2.8 | 20 | 2.5 | 2.58 | −12.88 | The invention |

As is evident from Table 7, the charging amount can be regulated by regulating the thickness of the surface layer, whereby the developer holding member having preferable charging amount can be produced.

Example 3

A developer holding member having an undercoat layer composed of copper and a surface layer composed of tin is prepared.

(Preparation of Developer Holding Member Sn-1)

-Preparation of an Undercoat Layer-

An aluminum pipe (substrate) subjected to blasting in the same manner as in Example 1 is subjected to electrolysis with a main agent (trade name: cupper (I) cyanide, manufactured by KANTO CHEMICAL CO., INC.), to form an undercoat layer of copper having a thickness of 3.5 μm.

-Formation of a Surface Layer-

A treating solution is prepared by adding a brightener (mixture of Topflowna R (trade name) and Topflowna MU (trade name) (mixing ratio 2/5), manufactured by Okuno Chemical Industries Co., Ltd.) in an amount of 28 ml/l to a tin bath produced by using a main agent (trade name: tin (II) sulfate, manufactured by KANTO CHEMICAL CO., INC.). The treating solution is used in tin electrolysis where the substrate provided with the undercoat layer is used as a cathode, to form a surface layer composed of tin thereon.

After tin electrolysis, the substrate is washed several times with water and then dried for 10 minutes or more in an atmosphere at 100° C., to prepare a developer holding member Sn-5. The specular gloss at 60°, Gs (60°), of the resulting surface layer, as determined by the method described above, is 29. The arithmetic mean surface roughness $Ra_2$ of the surface layer is 1.91 μm, and the mean layer thickness is 3 μm.

(Preparation of Developer Holding Members Sn-2 to Sn-9)

Developer holding members Sn-2 to Sn-9 are prepared in the same manner as for the developer holding member Sn-1 except that while the brightener is added in an amount of 28 ml/l in preparation of the developer holding member Sn-1, the amount of the brightener added is regulated so as to attain gloss shown in Table 8. The specular gloss at 60°, Gs (60°), arithmetic mean surface roughness $Ra_2$ and average thickness of the resulting surface layer are shown in Table 8.

(Preparation of Developer Holding Members Sn-10 to Sn-14)

Developer holding members Sn-10 to Sn-14 are prepared in the same manner as in preparation of the developer holding member Sn-1 except that in the blasting treatment of the aluminum substrate, the blasting pressure/time is regulated to change the surface roughness of the substrate. The arithmetic mean surface roughness $Ra_1$ of the substrate is measured, and the result is shown in Table 9.

The resulting developer holding members Sn-1 to Sn-14 are evaluated in the same manner as in Example 1. The results are shown in Tables 8 and 9.

TABLE 8

| Developer holding member | Substrate Surface roughness ($Ra_1$) | Surface layer Specular gloss at 60° (Gs (60°)) | Thickness Mean (μm) | Surface roughness ($Ra_2$) Mean (μm) | Image ghost | Remarks |
|---|---|---|---|---|---|---|
| Sn-1 | 2.4 | 29 | 3 | 1.91 | G1 | The invention |
| Sn-2 | 2.4 | 10 | 3 | 2.36 | G3 | The invention |
| Sn-3 | 2.4 | 13 | 3 | 2.31 | G2 | The invention |
| Sn-4 | 2.4 | 15 | 3 | 2.28 | G1 | The invention |
| Sn-5 | 2.4 | 20 | 3 | 2.07 | G1 | The invention |
| Sn-6 | 2.4 | 35 | 3 | 1.72 | G2 | The invention |
| Sn-7 | 2.4 | 40 | 3 | 1.60 | G3 | The invention |
| Sn-8 | 2.4 | 9 | 3 | 2.40 | G4 | Comparative Example |
| Sn-9 | 2.4 | 41 | 3 | 1.55 | G4 | Comparative Example |

TABLE 9

| Developer holding member | Substrate Surface roughness ($Ra_1$) Mean (μm) | Surface layer Specular gloss at 60° (Gs (60°)) | Thickness Mean (μm) | Surface roughness ($Ra_2$) Mean (μm) | Image ghost | Remarks |
|---|---|---|---|---|---|---|
| Sn-10 | 0.5 | 98 | 3 | 0.20 | — | Comparative Example |
| Sn-11 | 1.5 | 39 | 3 | 1.10 | G2 | The invention |
| Sn-12 | 2.5 | 19 | 3 | 2.01 | G1 | The invention |
| Sn-13 | 3.2 | 16 | 3 | 2.85 | G1 | The invention |
| Sn-14 | 3.5 | 14 | 3 | 3.14 | G2 | The invention |

Tables 8 and 9 indicate that when the undercoat layer of copper and the surface layer of tin are present, any developer holding members suppress generation of the image ghost insofar as the surface of the substrate is roughened and simultaneously the specular gloss at 60°, Gs (60°), of the surface layer is in the range of 10 to 40.

Table 9 indicates that when the surface roughness of the substrate is changed, the surface roughness of the surface layer is also changed, and as a result, the specular gloss at 60°, Gs (60°), is changed, and even in this case, the developer holding member suppresses generation of the image ghost when the Gs (60°) is in the range of 10 to 40. The developer holding member Sn-10 makes use of a cut pipe as a substrate having a surface roughness $Ra_1$ of 0.5 μm, not subjected to surface roughening, so the surface roughness of the surface layer is lower due to the surface roughness of the substrate, and thus the amount of the developer delivery is decreased, and image density is lowered. Accordingly, evaluation of the image ghost is not conducted.

In measurement of the amount of the toner delivered, the toner on the surface of the developer holding member is suctioned and the weight of the toner is measured. Specifically, a masking jig having an opening area of 2.5 $cm^2$ with the same surface curvature as that of the developer holding member is set on the developer holding member, and the toner on a sleeve, exposed to the masking opening, is suctioned through a nozzle and retained in a Faraday gauge to measure a difference in weight before and after suction in order to determine the amount of the toner delivered.

Example 4

A developer holding member having an undercoat layer composed of copper and a surface layer composed of nickel is prepared.

(Preparation of Developer Holding Member Ni-1)

-Preparation of an Undercoat Layer-

An aluminum pipe (substrate) subjected to blasting in the same manner as in Example 1 is subjected to electrolysis with a main agent (trade name: cupper (I) cyanide, manufactured by KANTO CHEMICAL CO., INC.), to form an undercoat layer of copper having a thickness of 3.5 μm.

-Formation of a Surface Layer-

A treating solution is prepared by adding a brightener (mixture of #810 (trade name)/#830 (trade name) (mixing ratio (volume ratio) 1/3), manufactured by Ebara-UDYLITE CO., LTD.) in an amount of 20 ml/l to a nickel bath produced by using a main agent (mixture of Ni sulfate (trade name) manufactured by Sumitomo Metal Mining Co., Ltd. and nickel chloride (trade name) manufactured by Nippon Kagaku Sangyo Co., Ltd. (mixing ratio (mass ratio) 5/1). The treating solution is used in nickel electrolysis where the substrate provided with the undercoat layer is used as a cathode, to form a surface layer composed of nickel thereon.

After nickel electrolysis, the substrate is washed several times with water and then dried for 10 minutes or more in an atmosphere at 100° C., to prepare a developer holding member Ni-1. The specular gloss at 60°, Gs (60°), of the resulting surface layer, as determined by the method described above, is 18. The arithmetic mean surface roughness $Ra_2$ of the surface layer is 2.63 μm, and the mean layer thickness is 3 μm.

(Preparation of Developer Holding Members Ni-2 to Ni-9)

Developer holding members Ni-2 to Ni-9 are prepared in the same manner as for the developer holding member Ni-1 except that while the brightener is added in an amount of 20 ml/l in preparation of the developer holding member Ni-1, the amount of the brightener added is regulated so as to attain gloss shown in Table 10. The specular gloss at 60°, Gs (60°), arithmetic mean surface roughness $Ra_2$ and mean thickness of the resulting surface layer are shown in Table 10.

(Preparation of Developer Holding Members Ni-10 to Ni-14)

Developer holding members Ni-10 to Ni-14 are prepared in the same manner as in preparation of the developer holding member Ni-1 except that in the blasting treatment of the aluminum substrate, the blasting pressure/time is regulated to change the surface roughness of the substrate. The arithmetic mean surface roughness $Ra_1$ of the substrate is measured, and the result is shown in Table 11.

The resulting developer holding members Ni-1 to Ni-14 are evaluated in the same manner as in Example 1. The results are shown in Tables 10 and 11.

TABLE 10

| Developer holding member | Substrate Surface roughness ($Ra_1$) | Surface layer Specular gloss at 60° (Gs (60°)) | Thickness Mean (μm) | Surface roughness ($Ra_2$) Mean (μm) | Image ghost | Remarks |
|---|---|---|---|---|---|---|
| Ni-1 | 3 | 18 | 3 | 2.63 | G1 | The invention |
| Ni-2 | 3 | 10 | 3 | 2.97 | G3 | The invention |

TABLE 10-continued

| Developer holding member | Substrate Surface roughness ($Ra_1$) | Surface layer: Specular gloss at 60° (Gs (60°)) | Surface layer: Thickness Mean (μm) | Surface layer: Surface roughness ($Ra_2$) Mean (μm) | Image ghost | Remarks |
|---|---|---|---|---|---|---|
| Ni-3 | 3 | 13 | 3 | 2.88 | G2 | The invention |
| Ni-4 | 3 | 15 | 3 | 2.75 | G1 | The invention |
| Ni-5 | 3 | 30 | 3 | 2.40 | G2 | The invention |
| Ni-6 | 3 | 35 | 3 | 2.31 | G2 | The invention |
| Ni-7 | 3 | 40 | 3 | 2.12 | G3 | The invention |
| Ni-8 | 3 | 9 | 3 | 3.00 | G4 | Comparative Example |
| Ni-9 | 3 | 41 | 3 | 2.13 | G4 | Comparative Example |

TABLE 11

| Developer holding member | Substrate: Surface roughness ($Ra_1$) Mean (μm) | Surface layer: Specular gloss at 60° (Gs (60°)) | Surface layer: Thickness Mean (μm) | Surface layer: Surface roughness ($Ra_2$) Mean (μm) | Image ghost | Remarks |
|---|---|---|---|---|---|---|
| Ni-10 | 0.5 | 60 | 3 | 0.30 | — | Comparative Example |
| Ni-11 | 1.4 | 25 | 3 | 1.00 | G2 | The invention |
| Ni-12 | 2.5 | 21 | 3 | 2.08 | G1 | The invention |
| Ni-13 | 3.2 | 17 | 3 | 2.81 | G1 | The invention |
| Ni-14 | 3.5 | 15 | 3 | 3.02 | G2 | The invention |

Tables 10 and 11 indicate that even when the undercoat layer of copper and the surface layer of nickel are present, any developer holding members suppress generation of the image ghost insofar as the surface of the substrate is roughened and simultaneously the specular gloss at 60°, Gs (60°), of the surface layer is in the range of 10 to 40.

Table 11 indicates that when the surface roughness of the substrate is changed, the surface roughness of the surface layer is also changed, and as a result, the specular gloss at 60°, Gs (60°), is changed, and even in this case, the developer holding member suppresses generation of the image ghost when the Gs (60°) is in the range of 10 to 40. The developer holding member Ni-10 makes use of a cut pipe as a substrate having a surface roughness $Ra_1$ of 0.5 μm, not subjected to surface roughening, so the surface roughness of the surface layer is lower due to the surface roughness of the substrate, and thus the amount of the developer delivery is decreased, and image density is lowered. Accordingly, evaluation of the image ghost is not conducted.

Example 5

A developer holding member having an undercoat layer composed of nickel and a surface layer composed of copper is prepared.

(Preparation of Developer Holding Member Cu-1)

-Preparation of an Undercoat Layer-

An aluminum pipe (substrate) subjected to blasting in the same manner as in Example 1 is subjected to non-electro plating with a main agent (trade name: Topnicolon BL-M/BL-1, manufactured by Okuno Chemical Industries Co., Ltd.), to form an undercoat layer of nickel having a thickness of 3.0 μm thereon.

-Formation of a Surface Layer-

A treating solution is prepared by adding a brightener (mixture of Elecopper 25MU (trade name) and Elecopper 25A (trade name) (mixing ratio (volume ratio) 10/1), manufactured by Okuno Chemical Industries, Co., Ltd.) in an amount of 5.5 ml/l to a copper sulfate bath produced by using a main agent (high-purity copper sulfate crystal (trade name) manufactured by Nikko Materials CO., LTD). The treating solution is used in copper electrolysis where the substrate provided with the undercoat layer is used as a cathode, to form a surface layer composed of copper thereon.

After copper electrolysis, the substrate is washed several times with water and then dried for 10 minutes or more in an atmosphere at 50° C., to prepare a developer holding member Cu-1. The specular gloss at 60°, Gs (60°), of the resulting surface layer, as determined by the method described above, is 19. The arithmetic mean surface roughness $Ra_2$ of the surface layer is 1.95 μm, and the mean layer thickness is 3 μm.

(Preparation of Developer Holding Members Cu-2 to Cu-9)

Developer holding members Cu-2 to Cu-9 are prepared in the same manner as for the developer holding member Cu-1 except that while the brightener is added in an amount of 5.5 ml/l in preparation of the developer holding member Cu-1, the amount of the brightener added is regulated so as to attain gloss shown in Table 12. The specular gloss at 60°, Gs (60°), arithmetic mean surface roughness $Ra_2$ and mean thickness of the resulting surface layer are shown in Table 12.

(Preparation of Developer Holding Members Cu-10 to Cu-14)

Developer holding members Cu-10 to Cu-14 are prepared in the same manner as in preparation of the developer holding member Cu-1 except that in the blasting treatment of the aluminum substrate, the blasting pressure/time is regulated to change the surface roughness of the substrate. The arithmetic mean surface roughness $Ra_1$ of the substrate is measured, and the result is shown in Table 13.

The resulting developer holding members Cu-1 to Cu-14 are evaluated in the same manner as in Example 1. The results are shown in Tables 12 and 13.

TABLE 12

| Developer holding member | Substrate Surface roughness ($Ra_1$) | Surface layer: Specular gloss at 60° (Gs (60°)) | Surface layer: Thickness Mean (μm) | Surface layer: Surface roughness ($Ra_2$) Mean (μm) | Image ghost | Remarks |
|---|---|---|---|---|---|---|
| Cu-1 | 2.4 | 19 | 3 | 1.95 | G1 | The invention |
| Cu-2 | 2.4 | 10 | 3 | 2.36 | G3 | The invention |
| Cu-3 | 2.4 | 13 | 3 | 2.24 | G2 | The invention |
| Cu-5 | 2.4 | 30 | 3 | 1.80 | G2 | The invention |
| Cu-6 | 2.4 | 35 | 3 | 1.74 | G2 | The invention |
| Cu-7 | 2.4 | 40 | 3 | 1.72 | G3 | The invention |
| Cu-8 | 2.4 | 9 | 3 | 2.40 | G4 | Comparative Example |
| Cu-9 | 2.4 | 41 | 3 | 1.41 | G4 | Comparative Example |

TABLE 13

| Developer holding member | Substrate: Surface roughness ($Ra_1$) Mean (μm) | Surface layer: Specular gloss at 60° (Gs (60°)) | Surface layer: Thickness Mean (μm) | Surface layer: Surface roughness ($Ra_2$) Mean (μm) | Image ghost | Remarks |
|---|---|---|---|---|---|---|
| Cu-10 | 0.5 | 98 | 3 | 0.20 | — | Comparative Example |
| Cu-11 | 1.6 | 35 | 3 | 1.00 | G2 | The invention |
| Cu-12 | 2.5 | 18 | 3 | 2.01 | G1 | The invention |
| Cu-13 | 3.2 | 15 | 3 | 2.81 | G1 | The invention |
| Cu-14 | 3.5 | 13 | 3 | 3.12 | G2 | The invention |

Tables 12 and 13 indicate that when the undercoat layer of nickel and the surface layer of copper are present, any developer holding members suppress generation of the image ghost insofar as the surface of the substrate is roughened and simultaneously the specular gloss at 60°, Gs (60°), of the surface layer is in the range of 10 to 40.

Table 13 indicates that when the surface roughness of the substrate is changed, the surface roughness of the surface layer is also changed, and as a result, the specular gloss at 60°, Gs (60°), is changed, and even in this case, the developer holding member suppresses generation of the image ghost when the Gs (60°) is in the range of 10 to 40. The developer holding member Cu-10 makes use of a cut pipe as a substrate having a surface roughness $Ra_1$ of 0.5 μm, not subjected to surface roughening, so the surface roughness of the surface layer is lower due to the surface roughness of the substrate, and thus the amount of the developer delivery is decreased, and image density is lowered. Accordingly, evaluation of the image ghost is not conducted.

What is claimed is:

1. A developer holding member having a surface layer composed of metal on or above a roughened hollow cylindrical substrate, wherein a specular gloss at 60°, Gs (60°), of the surface layer is in the range of approximately 10 to 40 gloss units.

2. The developer holding member of claim 1, wherein an arithmetic mean surface roughness, $Ra_2$, of the surface layer is in the range of approximately 1.0 μm to 3.2 μm.

3. The developer holding member of claim 1, wherein a metal forming the surface layer is at least one metal selected from the group consisting of Ni, Cu, Zn, Sn and alloys thereof.

4. The developer holding member of claim 1, wherein a thickness of the surface layer is in the range of approximately 0.3 μm to 30 μm.

5. The developer holding member of claim 1, wherein the surface layer comprises a brightener.

6. The developer holding member of claim 1, wherein a ratio of the arithmetic mean surface roughness $Ra_2$ of the surface layer to the arithmetic mean surface roughness $Ra_1$ of the substrate, that is, $Ra_2/Ra_1$, is approximately 0.7 to less than 1.

7. The developer holding member of claim 1, wherein an arithmetic mean surface roughness $Ra_1$ of the substrate is in the range of approximately 1.4 μm to 3.5 μm.

8. The developer holding member of claim 1, wherein the substrate is aluminum or an alloy thereof.

9. The developer holding member of claim 1, wherein the substrate is surface-roughened by blasting, honing, or grinding with a grindstone.

10. The developer holding member of claim 1, wherein an undercoat layer composed of at least one metal selected from the group consisting of Ni and Cu is arranged between the substrate and the surface layer.

11. The developer holding member of claim 10, wherein a thickness of the undercoat layer is in the range of approximately 1.5 μm to 4.0 μm.

12. The developer holding member of claim 10, wherein the undercoat layer is formed by non-electro plating.

13. A developing apparatus comprising the developer holding member of claim 1, a developer supplying unit that supplies a developer onto the developer holding member, and a charging unit that charges the developer supplied from the developer supplying unit.

14. The developing apparatus of claim 13 wherein the developer is a magnetic one-component developer.

15. An image forming apparatus comprising at least a latent image holding member, a charging unit that charges a surface of the latent image holding member, a latent image forming unit that forms a latent image on the surface of the latent image holding member, the developing apparatus of claim 13 for developing the latent image with a toner to form a toner image, a transferring unit that transfers the toner image onto a transfer receiving material, and a fixing unit that fixes the toner image onto the transfer receiving material.

16. A method of producing the developer holding member of claim 1, comprising forming a surface layer by electroplating a roughened hollow cylindrical substrate with a metal-containing electrolyte to form a surface layer having a specular gloss at 60°, Gs (60°), of approximately 10 to 40 gloss units composed of a metal, on or above the surface of the substrate.

17. The method of producing a developer holding member of claim 16, wherein the metal is at least one metal selected from the group consisting of Ni, Cu, Zn, Sn and alloys thereof.

18. The method of producing a developer holding member of claim 16, which comprises roughening the surface of the substrate in the developer holding member to make an arithmetic mean surface roughness, $Ra_1$, in the range of approximately 1.4 μm to 3.5 μm.

* * * * *